United States Patent [19]

Perner et al.

[11] 4,239,552

[45] Dec. 16, 1980

[54] MACHINE DISHWASHING, USING POLYHYDRIC ALCOHOLS, CARBOXYLIC ACIDS AND OR ESTERS OF THESE AS RINSING AGENTS

[75] Inventors: Johannes Perner, Neustadt; Dieter Stoeckigt, Ludwigshafen; Paul Diessel, Mannheim; Franz Merger, Frankenthal; Juergen Paetsch, Wachenheim, all of Fed. Rep. of Germany

[73] Assignee: BASF Aktiengesellschaft, Fed. Rep. of Germany

[21] Appl. No.: 59,776

[22] Filed: Jul. 23, 1979

[30] Foreign Application Priority Data

Aug. 3, 1978 [DE] Fed. Rep. of Germany ..... 2833991

[51] Int. Cl.[3] ..... C11D 1/72; C11D 3/20; C11D 7/08; C11D 7/26

[52] U.S. Cl. ..... 134/28; 134/26; 252/89.1; 252/139; 252/142; 252/143; 252/162; 252/170; 252/173; 252/174.19; 252/174.21; 252/363.5; 252/364; 252/DIG. 1; 252/DIG. 10; 252/DIG. 14; 568/853

[58] Field of Search ..... 134/26, 28, 42; 252/89.1, 122, 132, 139, 136, 142, 143, 153, 158, 162, 170, 173, 174.21, 174.22, 363.5, 364, DIG. 1, DIG. 10, DIG. 14; 260/561 B, 561 R; 568/853

[56] References Cited

U.S. PATENT DOCUMENTS

| | | | |
|---|---|---|---|
| 3,211,659 | 10/1965 | Pikaar | 252/136 |
| 3,463,735 | 8/1969 | Stonebraker | 252/139 X |
| 3,481,881 | 12/1969 | Wedell | 252/142 |
| 3,592,774 | 7/1971 | Altenschopfer | 252/170 X |
| 3,692,684 | 9/1972 | Hentschel | 252/174.19 |
| 3,779,934 | 12/1973 | Altenschopfer | 252/142 |
| 3,941,713 | 3/1976 | Dawson | 252/142 |
| 3,969,134 | 7/1976 | Batka | 134/26 |

OTHER PUBLICATIONS

Schönfeldt, N. "Grenzflächenaktive Äthylenoxide-Addukte", Wiss. Verl. Stuttgart (1976), pp. 527-529.

*Primary Examiner*—Dennis L. Albrecht
*Attorney, Agent, or Firm*—Keil & Witherspoon

[57] ABSTRACT

A process for machine dishwashing, employing a rinsing liquor which contains carboxylic acids or hydroxycarboxylic acids or mixtures of these and dihydric, trihydric or tetrahydric alcohols, the alcohols and carboxylic acids being of 5 to 9 carbon atoms, of which one carbon atom is quaternary, the alcoholic hydroxyl groups being exclusively primary and the carboxyl group being bonded to the quaternary carbon atom.

7 Claims, No Drawings

MACHINE DISHWASHING, USING POLYHYDRIC ALCOHOLS, CARBOXYLIC ACIDS AND OR ESTERS OF THESE AS RINSING AGENTS

The present invention relates to a process for machine dishwashing which comprises one or more cleaning and rinsing cycles, and wherein the rinsing agents employed are special alcohols, carboxylic acids and/or esters thereof, which in particular exhibit greater wetting capacity (allowing better draining of the rinsing liquor), spot-removing capacity and haze-removing capacity than conventionally employed materials of this type.

It has been found in practice that dishwashing must in general be carried out with two washing cycles, employing different products, the two cycles usually being separated by an intermediate water wash.

The actual detergent liquor contains alkaline agents in order to dissolve off, and emulsify, food bits. On the other hand, in the rinsing liquor, special rinsing agents are used to give dishes which are bright and free from spots and haze.

These rinsing agents must possess a good wetting action so that the rinsing water drains off the dishes as a film and does not leave any visible residues.

A large number of such agents are known, examples being wetting agents such as adducts of ethylene oxide and/or propylene oxide with alcohols, phenols or amines, and ethylene oxide/propylene oxide block copolymers. However, used by themselves these agents are in many cases insufficient to achieve a complete rinsing effect, and therefore organic acids, eg. citric acid or dicarboxylic acids, eg. adipic acid, with or without monohydric or polyhydric alcohols, eg. isopropanol, ethanol, ethylene glycol or butyldiglycol have been employed as solubilizers which do effect an improvement. Arylsulfonates, eg. sodium cumenesulfonate, have also been used for this purpose.

However, even these measures are not successful in every case, especially when rinsing fine porcelain or glasses, ie. articles on which the slightest spot or streak is visible.

It is an object of the present invention to provide a process, based on knowledge gathered hitherto, which gives more effective rinsing and nevertheless does not add to the cost of the process.

We have found that this object is achieved, surprisingly, by a process which, as hitherto, comprises several cleaning and rinsing cycles and wherein, additionally to the conventional materials mentioned above, special alcohols, carboxylic acids and/or esters thereof are added to the rinsing liquor. These compounds are dihydric, trihydric or tetrahydric alcohols and carboxylic or hydroxycarboxylic acids the alcohols and carboxylic acids being of 5 to 9 carbon atoms, of which one carbon atom is quaternary, the alcoholic hydroxyl groups being exclusively primary and the carboxyl group being bonded to the quaternary carbon atom.

By adding these agents it proves possible, in most cases, to achieve better results than with conventional formulations in respect of draining of the rinsing liquor, haze, streaks and spots, as will be explained in detail below.

The active substances according to the invention are the alcohols, carboxylic acids, hydroxycarboxylic acids and esters (obtained from the alcohols and carboxylic acids) which have been defined above, and especially mixtures of these compounds and more particularly still a triple combination which exhibits an additional unexpected synergistic effect in respect of improved rinsing action.

The alcohols are dihydric, trihydric or tetrahydric and are of 5 to 9 carbon atoms, of which one carbon atom is quaternary. The alcoholic hydroxyl groups should be primary.

Examples of these alcohols are neopentyl glycol, trimethylolpropane, pentaerythritol and homologs of these which instead of methylol or methyl groups carry ethyl or hydroxyethyl groups on the quaternary carbon atom. The alcohols must, as stated, carry primary OH groups. For the purposes of the invention, neopentyl glycol, trimethylolpropane, pentaerythritol and mixtures of these are preferred.

The carboxylic acids and hydroxycarboxylic acids conform to the same structural principle; they should also be of 5 to 9 carbon atoms, of which one carbon atom is quaternary. They contain one carboxyl group, bonded to the quaternary carbon atom. They can also contain up to 3 hydroxyl groups, but preferably one hydroxyl group, these groups being primary.

Preferred examples of these acids are pivalic acid and more especially still hydroxypivalic acid, the latter being an oxidation product of neopentyl glycol.

The esters of the alcohols and acids are also effective; amongst these, esters of neopentyl glycol, trimethylolpropane and pentaerythritol with pivalic acid or hydroxypivalic acid are preferred. The esters can be partial esters or complete esters, but the completely esterified alcohols and carboxylic acids are preferred. Furthermore, the esters should not be polymeric—as would be conceivable in the case of dicarboxylic acids—ie. the esterification should be controlled so as to give a monomeric ester.

The three possible types of compound are even individually very effective and give clearly improved rinsing effects.

However, mixtures of the alcohols, acids and esters which have been defined are substantially more effective, and this is particularly surprising.

Such combinations may be of alcohols and acids, alcohols and esters or acids and esters or may contain all three components, these latter combinations being the most effective.

Any ratio may be employed in binary combinations, but advantageously the alcohol or ester should be present in an amount of at least 50% by weight, based on the mixture.

The ternary combinations advantageously contain from 30 to 50 parts by weight of alcohol, from 5 to 15 parts by weight of carboxylic acid or hydroxycarboxylic acid and from 40 to 60 parts by weight of the ester.

A preferred ternary combination is a mixture of neopentyl glycol, hydroxypivalic acid and neopentyl glycol hydroxypivalic acid ester in the stated ratios.

This latter mixture is industrially particularly easily obtainable.

The agents, or agent combinations, to be employed according to the invention may be added to the rinsing liquor concentrates in amounts of up to 30% by weight. Larger amounts can be used but offer no additional advantages.

Advantageously, the agents are employed in amounts of from 0.2 to 10% by weight, based on the weight of concentrate. An optimum effect is achieved on adding from 3 to 8% by weight.

Furthermore, the rinsing liquors contain the surfactants which are conventionally used for this purpose and should be very low-foaming. Such surfactants are the previously mentioned adducts of ethylene oxide and/or propylene oxide with alkylphenols, relatively long-chain aliphatic primary or secondary alcohols, relatively long-chain amines, fatty acids or fatty acid amides or alkylolamides. A complete list of these would go outside the scope of the present description; reference may be made, for example, to the monograph by Schönfeld "Oberflächenaktive Anlagerungsprodukte des Äthylenoxids", Wiss. Verlagsanstalt Stuttgart (1976). $C_{10}$–$C_{20}$-alcohols with a low degree of oxyalkylation, ie. containing from about 2 to 10 ethylene oxide groups, have proved particularly suitable; they are very low-foaming products. The liquor concentrates in general contain from 1.5 to 50% by weight of the surfactants.

The concentrates may also contain the conventionally used solubilizers, eg. a toluenesulfonate or cumenesulfonate, an alcohol, eg. isopropanol or ethanol, a glycol, eg. ethylene glycol, butyldiglycol or 1,4-butanediol, and the like, in amounts of up to 30% by weight, especially if the surfactants used have too low a cloud point (<60° C.), ie. if a hot rinse is used.

Finally, the acids hitherto used for this purpose, eg. phosphoric acid, citric acid, tartaric acid or dicarboxylic acids, eg. glutaric acid, succinic acid or adipic acid, or mixtures of these, can also be employed, in amounts of up to 10% by weight, though their use is no longer essential.

The finished concentrates contain from 30 to 70% by weight of water and can be diluted to provide about 0.1 to 0.5 kg of concentrate per liter of water.

The addition of the agents according to the invention makes it possible to dispense entirely with solubilizers (for the purpose of raising the cloud point), since a completely satisfactory rinsing effect is achieved even at 30°–40° C. However, if a hot rinse is used, the agents according to the invention produce very good effects when used in conjunction with the other additives.

It is surprising that, for example, the addition of 1,4-butanediol instead of neopentyl glycol produces no effect whatsoever, and that citric acid, which is also a hydroxycarboxylic acid, has an effect which does not approach that of hydroxypivalic acid, especially if the latter is employed in combination with the alcohol and ester according to the invention.

The Examples which follow illustrate the invention.

EXAMPLES

Crystal glasses were subjected to a rinsing test at 45° C. in a dishwasher holding 10 liters of water.

The rinsing liquor (10 liters) contained 3 g of concentrate (0.3 g per liter).

Each rinse cycle took 9 minutes.

The composition of the rinse concentrates is shown in the Table which follows, the figures being percentages by weight. The figures of merit range from 1 (very poor) to 5 (very good).

TABLE

| Additive | Example No. 1 | 2 | 3 | 4 | 5 | 6 | 7 | 8 | 9 | 10 | 11 | 12 | 13 |
|---|---|---|---|---|---|---|---|---|---|---|---|---|---|
| $C_9/C_{11}$-Oxo-alcohol +7 ethylene oxide +1 butylene oxide | 20 | 20 | 20 | 20 | 20 | 20 | 20 | 20 | 20 | 20 | 20 | 20 | 20 |
| Na cumenesulfonate | 10 | 10 | 10 | 10 | 10 | 10 | 10 | 10 | 10 | 10 | 10 | 10 | 10 |
| NPG ⊕ | | 6.0 | | | | | | | | | | | |
| Neopentyl glycol | | | 6.0 | | | | | 2.4 | 5.4 | 2.4 | 2.4 | 5.4 | 5.4 |
| Neopentyl glycol hydroxypivalic acid ester | | | | 6.0 | | | | 3.0 | | 3.0 | 3.0 | | |
| Hydroxypivalic acid | | | | | 6.0 | | | | 0.6 | | | | |
| Mixtures of equal parts of succinic acid glutaric acid and adipic acid | | | | | | 6.0 | | | | 0.6 | | 0.6 | |
| Citric acid | | | | | | | 6.0 | | | | 0.6 | | 0.6 |
| **Figure of merit** | | | | | | | | | | | | | |
| Rinsing test (crystal glass) | | | | | | | | | | | | | |
| Draining | 3 | 4.5 | 4 | 3.5 | 3.5 | 3 | 3 | 3.5 | 3.5 | 4 | 4 | 3.5 | 3.5 |
| Haze | 3 | 4.5 | 4 | 4 | 4 | 3 | 3 | 4 | 3.5 | 3.5 | 3.5 | 4 | 4 |
| Streaks | 3 | 4.5 | 4.5 | 4 | 4 | 4 | 3.5 | 4 | 4 | 4 | 4 | 4 | 4 |
| Spots | 3 | 4.5 | 4.5 | 4 | 4 | 3 | 3 | 4 | 4 | 4 | 4 | 4.5 | 4.5 |

⊕ A mixture of 40 parts by weight of neopentyl glycol, 50 parts by weight of neopentyl glycol hydroxypivalic acid ester and 10 parts by weight of hydroxypivalic acid Temperature of the experiment: 45° C.

We claim:

1. In a process for the machine washing of dishes, using several cleaning and rinsing cycles, the rinsing being carried out with oxyalkylated compounds containing active hydrogen atoms and solubilizers, with or without monohydric or polyhydric alcohols, the improvement wherein a rinsing liquor concentrate is employed which contains dihydric, trihydric or tetrahydric alcohols, monobasic carboxylic or hydroxycarboxylic acids, or mixtures of these, the alcohols and carboxylic acids being of 5 to 9 carbon atoms, of which one carbon atoms is quaternary, the alcoholic hydroxyl groups being exclusively primary, and the carboxyl group being bonded to the quaternary carbon atom, the amount of compound containing a quaternary carbon atom being at least about 0.2% by weight based on the weight of the concentrate.

2. The process of claim 1, wherein the rinsing liquor contains a mixture of from 30 to 50 parts by weight of an alcohol, from 5 to 15 parts by weight of a carboxylic or hydroxycarboxylic acid and from 40 to 60 parts by weight of an ester of the alcohol and the hydroxycarboxylic acid.

3. The process of in claim 1 or 2, wherein the rinsing liquor contains neopentyl glycol, trimethylolpropane, pentaerythritol or a mixture of these as the alcohol, pivalic acid, hydroxypivalic acid or a mixture of these as the acid, and esters of the said alcohols and acids as the ester.

4. The process of in claim 2, wherein the rinsing liquor contains a mixture of neopentyl glycol, hydroxypivalic acid and neopentyl glycol hydroxypivalic acid ester.

5. The process of claim 1, wherein the amount of compound containing a quaternary carbon atom is from about 0.2 to 10% by weight, based on the weight of the concentrate.

6. The process of claim 1, wherein the amount of compound containing a quaternary carbon atom is from 3 to 8% by weight, based on the weight of the concentrate.

7. The process of claim 1, wherein the concentrate further contains an inorganic acid and/or an organic acid selected from the group consisting of phosphoric acid, citric acid, tartaric acid or dicarboxylic acids, e.g. glutaric acid, succinic acid or adipic acid in amounts up to 10% by weight based on the weight of the concentrate.

* * * * *